US009752348B2

(12) United States Patent
Leach et al.

(10) Patent No.: US 9,752,348 B2
(45) Date of Patent: Sep. 5, 2017

(54) HATCH-OPERATING TOOL FOR PNEUMATIC TANK TRAILERS

(71) Applicant: TERESA RUSTIN REED, INC., Seneca, SC (US)

(72) Inventors: Gregory R. Leach, Seneca, SC (US); Robert R. Malle, Sr., Seneca, SC (US)

(73) Assignee: TERESA RUSTIN REED, INC., Seneca, SC (US)

( * ) Notice: Subject to any disclaimer, the term of this patent is extended or adjusted under 35 U.S.C. 154(b) by 0 days.

(21) Appl. No.: 14/869,157

(22) Filed: Sep. 29, 2015

(65) Prior Publication Data

US 2017/0089096 A1 Mar. 30, 2017

(51) Int. Cl.

| | |
|---|---|
| ***E05B 1/00*** | (2006.01) |
| ***B25G 1/04*** | (2006.01) |
| ***B66F 19/00*** | (2006.01) |
| ***B66F 15/00*** | (2006.01) |

(52) U.S. Cl.

CPC ..... *E05B 1/0053* (2013.01); *B25G 1/04* (2013.01); *B66F 15/00* (2013.01); *B66F 19/005* (2013.01)

(58) Field of Classification Search

CPC ..... B66F 19/00; B66F 19/005; B66F 11/00; B65D 90/00; B65D 90/008

USPC ..... 254/131

See application file for complete search history.

(56) References Cited

U.S. PATENT DOCUMENTS

| | | | | |
|---|---|---|---|---|
| 3,837,622 A * | 9/1974 | Gale | B66F 19/005 | 254/131 |
| 4,644,600 A * | 2/1987 | Fugate | B25B 27/02 | 7/166 |
| 5,137,314 A * | 8/1992 | Gunter | B66F 19/005 | 254/131 |
| 5,832,794 A * | 11/1998 | Fowler | B25B 13/08 | 81/177.2 |
| 6,202,985 B1 * | 3/2001 | Chong | B66F 15/00 | 254/131 |

(Continued)

OTHER PUBLICATIONS

Harbor Frieght Tools. "Pry Bars—Save on Pry Bars at Harbor Freight." <http://www.harborfreight.com/hand-tools/pry-bars.html>. Retrieved Sep. 22, 2015. 3 pages.

(Continued)

*Primary Examiner* — Monica Carter
*Assistant Examiner* — Seahee Yoon
(74) *Attorney, Agent, or Firm* — Gardner Groff Greenwald & Villanueva, P.C.

(57) ABSTRACT

A tool for operating pivotal levers includes a lever member having an attachment and a handle. The attachment defines proximal-lower and distal-upper bearing surfaces for contacting the pivotal lever to transmit a pivotal opening force, and the proximal-upper and distal-lower bearing surfaces for contacting the pivotal lever to transmit a pivotal closing force. Typically, the tool includes hook retainers extending from the lever member that define the lower bearing surfaces. Also, the lower bearing surfaces and the handle define a clearance angle to avoid interference with an opposite lever. Typically, the lever member includes an angle between its attachment section and its handle section to define the clearance angle. Methods of installation and use of such a tool are also disclosed.

10 Claims, 9 Drawing Sheets

(56) References Cited

U.S. PATENT DOCUMENTS

| | | | | |
|---|---|---|---|---|
| 6,308,596 | B1 * | 10/2001 | Williams | B25G 1/043 81/177.1 |
| D476,203 | S * | 6/2003 | Mahan | D8/21 |
| D598,257 | S * | 8/2009 | Darby | D8/27 |
| 8,042,849 | B2 * | 10/2011 | Pratt | B66F 15/00 294/19.3 |
| 8,857,030 | B2 * | 10/2014 | Stutson, Jr. | B65D 90/00 254/131 |
| 8,893,355 | B2 * | 11/2014 | Longley | B25G 1/00 16/426 |
| 2005/0183550 | A1 * | 8/2005 | Day | B25G 1/043 81/177.2 |
| 2012/0313060 | A1 * | 12/2012 | Weinreich | B66F 15/00 254/131 |

OTHER PUBLICATIONS

King Tony America. "Wrenches." <http://shop.kingtonyamerica.com/c/wrenches>. Retrieved Sep. 22, 2015. 2 pages.

* cited by examiner

HATCH-OPERATING TOOL FOR PNEUMATIC TANK TRAILERS

TECHNICAL FIELD

The present invention relates generally to tools and implements, and particularly to tools and equipment used with pneumatic tank trailers in the trucking industry.

BACKGROUND

Pneumatic tank trailers (also referred to as "dry bulk trailers") are semi tractor trailers having pressurized tanks for carrying dry cargo such as concrete, dog food, corn, grains, flour, and sand, to name a few. The dry cargo is loaded into the tank at its top through cargo hatches and unloaded through a bottom discharge under pneumatic pressure. Each hatch includes a peripheral lip defining a hatch opening, a hatch cover that pivots between a closed position covering the hatch opening and an open position uncovering the hatch opening, and multiple levers (also referred to as "dogs") pivotally repositionable between a locked position securing the closed hatch cover and an unlocked position permitting the hatch cover to be moved to the open position. The tank hatches must be manually opened (typically by the driver) to load the cargo, then after loading the tank hatches must be manually closed.

Operating the hatches by hand is quite difficult at best, opening them much more so than closing them. That's because the tank must be pressurized to "blow off" the cargo it's carrying under considerable pressure (typically about 7 psi to about 12 psi), and in order to maintain an airtight seal at the hatches under these high pressures, the hatch-securing mechanism must be quite substantial in its construction. Typically there are six (sometimes more or less) of the pivotal levers that tighten-down each closed hatch cover by cam action to form the airtight seal under high pressures. And the hatches are on top of the tank, typically at or above twelve feet off the ground. So the operator must climb a ladder on the trailer to get to the top of the tank, bend over at the waist, jerk with considerable force on the handle of one of the levers—exerting an incredible amount of pressure on the lower back—to unlock it, repeat the unlocking step for all the other levers for that hatch, open that hatch, then repeat as needed for multiple hatches. Many drivers of pneumatic tank trailers have been known to say that the act of opening these hatches is the most difficult part of their job. In fact, the act of opening these hatches by hand has led to many on-the-job work-related injuries. And although an automatic powered hatch has been developed for ease of operation, they are extremely expensive and thus not commonplace.

Accordingly, it can be seen that needs exist for improvements to enable hatches of pneumatic tank trailers to be operated more easily. It is to the provision of solutions to these and other problems that the present invention is primarily directed.

SUMMARY

Generally described, the present invention relates to a tool for operating pivotal levers such a hatch levers of pneumatic tank trailers. In example embodiments, the tool includes a lever member having an attachment and a handle. The attachment defines proximal-lower and distal-upper bearing surfaces for contacting the pivotal lever to transmit a pivotal opening force, and the proximal-upper and distal-lower bearing surfaces for contacting the pivotal lever to transmit a pivotal closing force. Typically, the tool includes hook retainers extending from the lever member that define the lower bearing surfaces. Also, the lower bearing surfaces and the handle define a clearance angle to avoid interference with an opposite lever. Typically, the lever member includes an angle between its attachment section and its handle section to define the clearance angle. Methods of installation and use of such a tool are also disclosed.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Figure 1:
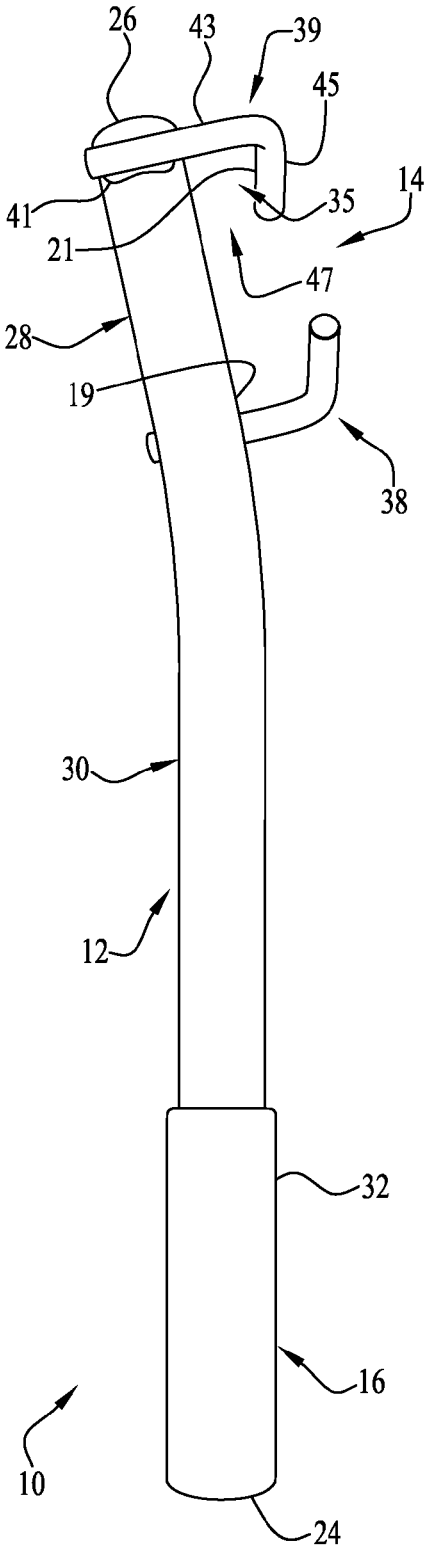
FIG. 1 is a side perspective view of a hatch-operating tool for pneumatic tank trailers according to a first example embodiment of the present invention.
Figure 2:
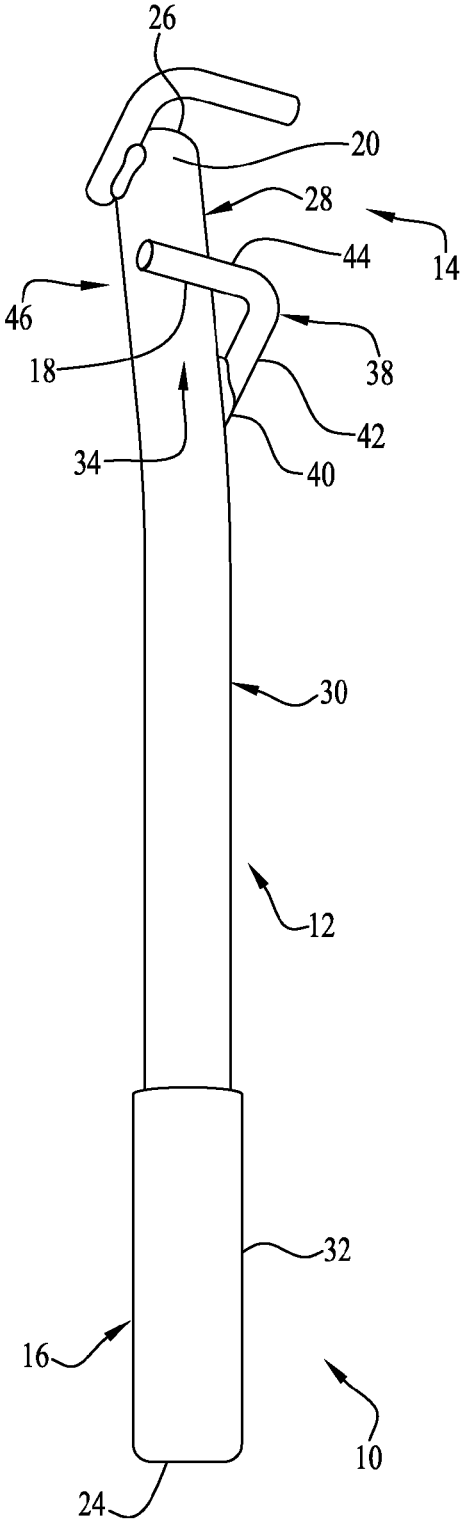
FIG. 2 is a bottom perspective view of the hatch-operating tool of FIG. 1.
Figure 3:
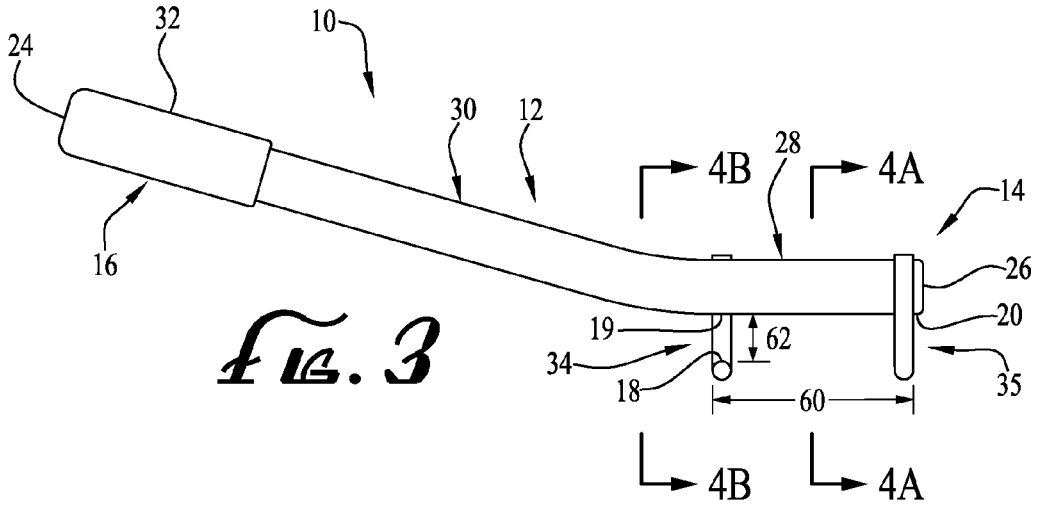
FIG. 3 is a side view of the hatch-operating tool of FIG. 1.
Figure 4A:
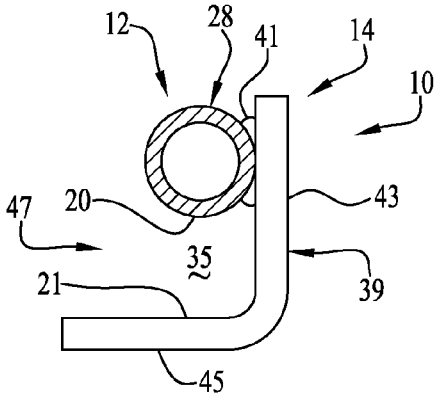
FIGS. 4A-4B are cross-sectional views of the hatch-operating tool taken at line 4A-4A and 4B-4B respectively of FIG. 3.
Figure 4B:
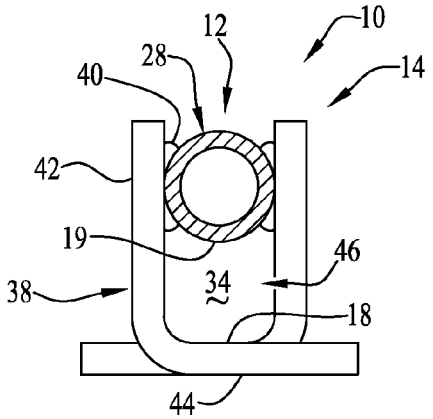
Figure 5:
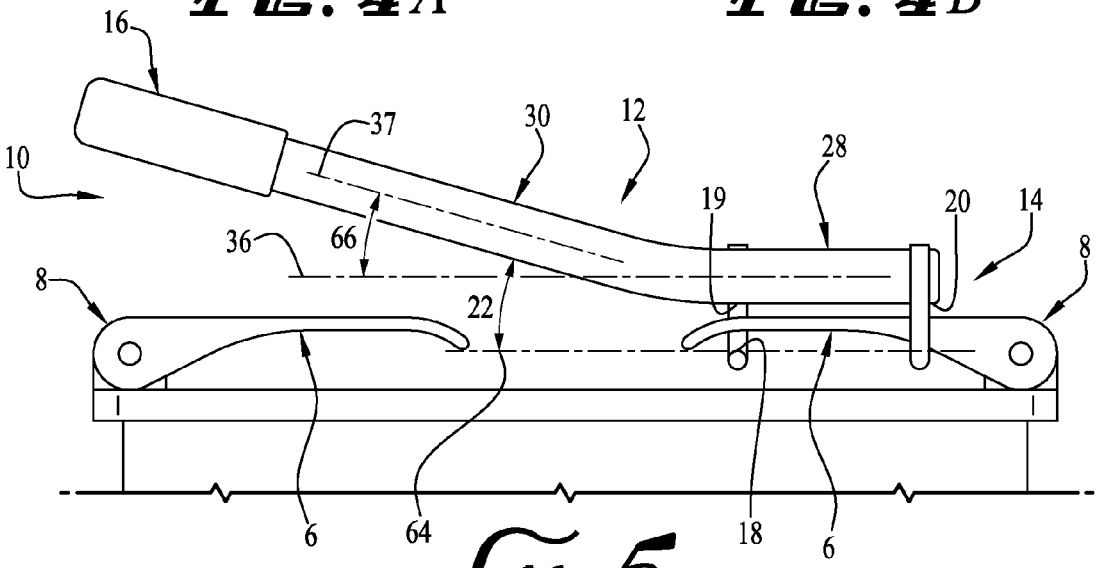
FIG. 5 is a side view of the hatch-operating tool of FIG. 1 shown removably coupled to a hatch lever for use while clear of an opposite hatch lever to avoid interference.

Generally described, the present invention relates to a tool and method for opening/unlocking and closing/locking pivotal levers of hatches. The tool and method are described herein with respect to use with pivotal levers of hatches of pneumatic tank trailers, with such hatches having pivotal cam-type levers (i.e., dogs) that are pivoted between a locked position securing the hatch cover closed and an unlocked position permitting the hatch cover to be opened. It will be understood by persons of ordinary skill in the art that the tool and method can be modified and used to operate other types of hatches and/or levers, for example non-cammed pivotal levers, pivotal levers not on pneumatic tank trailers (e.g., pivotal lock levers in industrial facilities), and/or laterally rotational levers. It will also be understood that reference herein to mounting, attaching, coupling, etc., the tool to the pivot lever means positioning it for use and not necessarily securing or fixing it in place.

FIGS. 1-17 show a tool 10, for opening and closing hatch assemblies (aka hatches) 8 of pneumatic tank trailers, according to a first example embodiment of the invention. The tool 10 includes a lever member 12 having an attachment 14 and a handle 16. The attachment 14 longitudinally aligns and overlaps with the pivotal lever 6, defines proximal-lower and distal-upper opening bearing surfaces 18 and 20, and defines proximal-upper and distal-lower closing bearing surfaces 19 and 21, all configured to cooperate to removably attach to the pivotal levers 6 of the hatch assembly 8. And the handle 16 is adapted for grasping and gripping by a hand of an adult human for manual use. The lower (proximal-opening and distal-closing) bearing surfaces 18 and 21 are configured at a clearance-providing angle 22 relative to the handle 16 so that, with the tool 10 mounted on the hatch pivotal lever 6, the handle vertically clears the aligned pivotal lever 6 on the opposite side of the hatch assembly 8. In this way, a user can temporarily attach the tool 10 to one of the hatch levers 6 to pivotally operate (open/unlock and close/lock) it while maintaining clearance from and avoiding interference with the opposite hatch lever 6.

Referring particularly to FIGS. 1-5, the lever member 12 includes a proximal end 24 and a distal end 26, with the handle section 16 adjacent the proximal end, an attachment section 28 adjacent the distal end 26, and an intermediate extension section 30 between the handle and attachment sections. The handle section 16 may include a sleeve or wrapped grip (e.g., made of a rubber or elastomeric material) 32, as depicted. The attachment section 28 is where the hatch-lever attachment 14 is located. And the extension section 30 separates the handle and attachment sections to provide a moment-arm length for leverage when using the tool 10.

In a typical embodiment, the lever member 12 is made of a piece of commercially available metal tubing (e.g., 1¼-inch O.D./1-inch I.D. heavy wall steel circular tubing) that is about 20 inches long. In other embodiments, the lever member is made of another material (selected for high strength), in another shape (e.g., a rectangular, polygonal, or another regular or irregular cross-sectional shape), and/or with another length (longer as desired, shorter while still providing the attachment length as described herein).

The proximal (lower-opening and upper-closing) bearing surfaces 18 and 19 of the attachment 14 at least partially define a proximal receptacle 34 that can receive the pivot lever 6 of the hatch 8 for use. Similarly, the distal (lower-opening and upper-closing) bearing surfaces 20 and 21 of the attachment 14 at least partially define a distal receptacle 35 that can receive the pivot lever 6 of the hatch 8 for use. The proximal bearing surfaces 18 and 19 are longitudinally spaced apart (along the longitudinal axis 36 of the lever attachment section 28) from the distal bearing surfaces 20 and 21 such that the proximal bearing surfaces are proximally positioned relative to the distal bearing surfaces. And the lower (proximal-opening and distal-closing) bearing surfaces 18 and 21 are transversely spaced apart (normally relative to the longitudinal axis 36 of the lever attachment section 28) from the upper (proximal-closing and distal-opening) bearing surfaces 19 and 20 such that the lower bearing surfaces are positioned lower relative to the upper bearing surfaces.

In this configuration, with the hatch lever 6 received in the tool attachment receptacles 34 and 35, the proximal-lower opening bearing surface 18 is positioned to apply a pivotal upward force on the hatch lever 6 and the distal-upper opening bearing surface 20 is positioned to provide an anchor or pivot point to transmit such pivotal force into an upward pivotal motion of the hatch lever. Similarly, the proximal-upper closing bearing surface 19 is positioned to apply a pivotal downward force on the hatch lever 6 and the distal-lower closing bearing surface 21 is positioned to provide an anchor or pivot point to transmit such pivotal force into a downward pivotal motion of the hatch lever. As such, the tool 10 can be mounted onto the hatch 8 with the hatch lever 6 received in the tool attachment receptacles 34 and 35, then the tool handle 16 can be pivoted upward to cause the proximal-lower and distal-upper opening bearing surfaces 18 and 20 to bear upon and torque the hatch lever 6 to pivot upward with it to unlock the hatch. Similarly, to lock the hatch 8, the tool handle 16 can be pivoted downward to cause the proximal-upper and distal-lower closing bearing surfaces 19 and 21 to bear upon and torque the hatch lever 6 to pivot downward with it.

In typical embodiments, the lower (proximal and distal) bearing surfaces 18 and 21 of the attachment 14 are defined by respective retainer members 38 and 39. That is, the proximal-lower bearing surface 18 is defined by a proximal retainer member 38 that at least partially defines the receptacle 34 and that extends from the lever member 12. And the distal-lower bearing surface 19 is defined by a distal retainer member 39 that at least partially defines the receptacle 35 and that extends from the lever member 12 at a distal position relative to the proximal retainer member. The proximal and distal retainer members 38 and 39 can be fixedly attached to the lever member 12 by conventional fasteners 40 and 41 such as welds (as depicted), clamps, bolts, rivets, or other conventional fasteners known in the art.

In the depicted embodiment, the proximal retainer 38 is in the form of a generally L-shaped or hook-shaped rod or bar having an extension arm portion 42 that extends transversely downwardly away from the lever member 12 and a holder arm portion 44 that is angled from the extension arm in a position so that it defines the proximal-lower opening bearing surface 18 facing back toward the lever member 12. Similarly, the depicted distal retainer 39 is in the form of a generally L-shaped or hook-shaped rod or bar having an extension arm portion 43 that extends transversely downwardly away from the lever member 12 and a holder arm portion 45 that is angled from the extension arm in a position so that it defines the distal-lower closing bearing surface 21 facing back toward the lever member 12. In this configuration, the retainer members 38 and 39 each define a respective side access opening (e.g., the respective gap between the respective holder arm and the lever member) 46 and 47 in communication with their respective receptacles 34 and 35, opposite their respective extension arms 40 and 41, and through which the hatch lever 6 can be received when the retainer member is slid laterally onto the hatch lever.

For example, one or both of the retainer members 38 and 39 can be made of ½-inch round stock steel, with the extension arm 40 and 41 being about 3 inches long and extending generally perpendicularly downward about 2 inches beyond the lever member 12, with the holder arms 42 and 43 being about 3 inches long and extending generally perpendicularly (e.g., about 88 degrees to about 95 degrees) laterally to below the lever member 12 (in its use position). Alternatively, one or both of the retainer members can be made of another material (e.g., a composite selected for high strength), have another lengthwise shape (e.g., C-shaped or Z-shaped), have another cross-sectional shape (e.g., a rectangular, polygonal, or another regular or irregular cross-sectional shape), have another length (longer as desired, shorter while still providing the bearing surface as described herein), and/or be integrally formed with the lever member. And in other alternative embodiments, one or both of the retainer members can be provided by one or more pieces of channel (C-shaped) or angle (L-shaped), or by plates or panels in other configurations, defining the receptacles, the access openings, and the bearing surfaces with a relatively greater length. The retainer members can optionally be provided with (additionally) or by (alternatively) clamps, clips, straps, pins, other retaining elements that help secure the hatch lever in the retainer receptacles.

In addition, in the depicted embodiment the upper (proximal and distal bearing surfaces 19 and 20 of the attachment 14 are defined by the lever member 12 itself. That is, the outer surface of the attachment section 28 of the lever member 16, located adjacent its distal end 26, forms the distal-upper bearing surface 20. And the outer surface of the attachment section 28 of the lever member 16, located proximally relative to the distal-upper bearing surface 20, forms the proximal-upper bearing surface 19. In other embodiments, one or both of the upper bearing surfaces of the attachment are defined by a saddle, plate, panel, boss, or other structural element (e.g., flat or concave) attached to or integrally formed with the attachment section of the lever member and suitable for bearing on the hatch lever.

In other embodiments, the lower and/or upper bearing surfaces of the attachment are defined by one or more peripheral structures such as a tube (e.g., with a circular or rectangular cross section) defining the proximal and distal receptacles but without access side openings (the peripheral structure is slid longitudinally onto the hatch lever). In some such embodiments, the attachment section of the lever member is hollow and serves as the peripheral structure defining the lower and/or upper bearing surfaces, and in other embodiments the peripheral structure is fixedly attached (by conventional fasteners) to the attachment section of the lever member. In some such embodiments the peripheral structure is cooperatively formed by a U-shaped member and the attachment section of the lever member (with the attachment section closing off the open side of the U-shaped member). In some such embodiments a single peripheral structure is provided that defines the proximal and distal bearing surfaces, while in other embodiments separate proximal and distal peripheral structures are provided for this purpose. And in some such embodiments, a proximal slot or other opening can be defined in the peripheral structure to receive a downward-angled end of the hatch lever for positioning and retention purposes.

In alternative embodiments designed for only opening the hatch lever, the distal retainer member can be provided by other retainer structures such as two side members (e.g., rods, bars, or panels) extending downward from the lever member and between which is defined a receptacle (with a bottom access opening) that receives the hatch lever with the side members retaining it there, with the side members provided by for example a piece of channel (inverted U-shaped), and thus without providing a distal-lower-closing bearing surface.

As previously referenced, the proximal-lower and distal-upper bearing surfaces 18 and 20 are longitudinally spaced apart from each other (along the longitudinal axis 36 of the lever attachment section 28) such that such that the proximal-lower bearing surface biases the hatch lever 6 pivotally upward and the distal-lower bearing surface provides an anchor or pivot point about which the opening pivotal motion is generated. Similarly, the proximal-upper and distal-low bearing surfaces 19 and 21 are longitudinally spaced apart from each other (along the longitudinal axis 36 of the lever attachment section 28) such that such that the proximal-upper bearing surface biases the hatch lever 6 pivotally downward and the distal-upper bearing surface provides an anchor or pivot point about which the closing pivotal motion is generated.

In the depicted embodiment, this is accomplished by spacing the proximal and distal retainer members 38 and 39 apart by a longitudinal spacing 60 that is selected to be long enough to generate a practical/helpful mechanical advantage but short enough to fit on the hatch lever and maintain bearing contact during use. The hatch levers 6 are typically about 9 inches long (with some of that length past/distal of its pivot point), so the longitudinal spacing 60 is less than that but not by more than needed to provide the functionality described herein. For example, the longitudinal spacing 60 of the retainer members 38 and 39, and thus of the proximal-most and distal-most edges of the proximal and distal bearing surfaces 18-19 and 20-21, can be about 4 inches.

As further previously referenced, the proximal lower and upper bearing surfaces 18 and 19 are transversely spaced apart from each other (normally relative to the longitudinal axis 36 of the lever attachment section 28) such that the proximal-lower bearing surface 18 is positioned below the hatch lever 6 to bias it pivotally upward in the opening pivotal motion during use and the proximal-upper bearing surface 19 is positioned above the hatch lever to bias it pivotally downward in the closing pivotal motion during use. Similarly, the distal upper and lower bearing surfaces 20 and 21 are transversely spaced apart from each other (normally relative to the longitudinal axis 36 of the lever attachment section 28) such that the distal-upper bearing surface 20 is positioned above the hatch lever 6 to provide an anchor or pivot point to facilitate it pivoting upward in the opening pivotal motion during use and the distal-lower bearing surface 21 is positioned below the hatch lever to provide an anchor or pivot point to facilitate it pivoting downward in the closing pivotal motion during use.

In the depicted embodiment, this is accomplished by offsetting the holder arms 42 and 43 of the retainers 38 and 39 from the lever member 12 by an offset spacing 62 that is selected to be large enough to permit the retainers to slip onto the hatch lever easily without undue interference but small enough to avoid excess looseness or play during use. The hatch levers 6 have a typical height/thickness of about ¼ inch to about ½ inch, so the offset spacing 62 is greater than that but not by more than needed to provide the functionality described herein. For example, the offset spacing 62 of the holder arms 42 and 43 of the retainer members 38 and 39, and thus the lower bearing surfaces 18 and 21, from the lever member 12 can be about 2 inches.

It should be noted that the depicted proximal (lower and upper) bearing surfaces 18 and 19 are aligned and facing each other, and the depicted distal (upper and lower) bearing surfaces 20 and 21 are aligned and facing each other, to provide maximal longitudinal spacing 60. In other embodiments, the proximal bearing surfaces are longitudinally and/or transversely offset from each other and/or the distal bearing surfaces are longitudinally and/or transversely offset from each other, as may be desired for other designs.

And as still further previously referenced, the extension section 30 (and the handle section 16 when aligned therewith) are configured at a clearance-providing angle 22 relative to the lower bearing surfaces 18 and 21 so that, with the tool 10 mounted on the hatch pivotal lever 6, the handle vertically clears the opposite pivotal lever 6 (on the opposite side of the hatch assembly 8). In particular, a centerline 37 of the extension section 30 of the lever member 12 and a longitudinal line 64 defined by the lower bearing surfaces 18 and 21 are not aligned and instead form the clearance angle 22. The clearance angle 22 is typically at least about 5 degrees so that a user can temporarily attach the tool 10 to one of the hatch levers 6 and with one hand grasp the handle section 16 of the tool 10 with the hand and the tool clear of and free of interference from the opposite hatch lever 6.

In typical embodiments, the clearance angle 22 is provided by forming an angle 66 in the lever member 12. In the depicted embodiment, the angle 66 is formed between the attachment section 28 (centerline 36) and the extension section 30 (centerline 37) of the lever member 12, with the angle typically being between about 5 degrees and about 20 degrees. For example, selecting the lever member angle 66 at about 10 degrees between the attachment section 28 and the extension section 30, with the attachment section 28 being about 7 inches long and the extension section 30 and the handle section 16 together being about 13 inches long, provides a minimum clearance between the opposite hatch lever 6 and the tool 10 of about 1 inch to about 2 inches when the attachment section 28 is generally parallel to the mounted-to hatch lever 6 (and more when the proximal-lower and distal-upper opening bearing surfaces 18 and 20 are both contacted by the hatch lever 6 during use). It should be noted that the lever member angle 66 can be less than and not provide the full clearance angle 22, as the offset spacing 62 for the lower bearing surfaces provides some looseness or play (for ease of hatch lever mounting) that can be used for the clearance-angle purposes described herein.

In other embodiments, the handle and/or extension section of the lever member are/is not angled from the attachment section (e.g., the lever member is generally straight), and instead the clearance angle is provided by the extension arm of the proximal retainer being longer than the extension arm of the distal retainer member.

In addition, the proximal and distal retainer members 38 and 39 of the depicted embodiment are oppositely arranged about the centerline of the attachment section 28 of the lever member 12. In particular, the access opening 46 for the receptacle 34 of the proximal retainer member 38 is on a first side of the lever member 12 (e.g., the right side, when holding the handle 16 for use and viewing it from the proximal end 24), with the extension arm 42 extending downward from the opposite second (e.g., left) side of the lever member. Similarly, the access opening 47 for the receptacle 35 of the distal retainer member 39 is on the second side of the lever member 12 (e.g., the left side), with the extension arm 43 extending downward from the opposite first (e.g., right) side of the lever member. In other embodiments, the retainer members are oppositely arranged in a vice-versa arrangement, or they are arranged with their extension arms on the same side of the lever member and their access openings on the opposite same side.

With this oppositely arranged configuration of the retainer 38 and 39, the tool 10 is well-retained on the hatch lever 6 so that it does not slip laterally under the large forces applied to it to open and close the hatch lever 6. Such slippage could result in the tool 10 coming loose from the hatch lever 6 and causing injury to the user.

Figure 6:
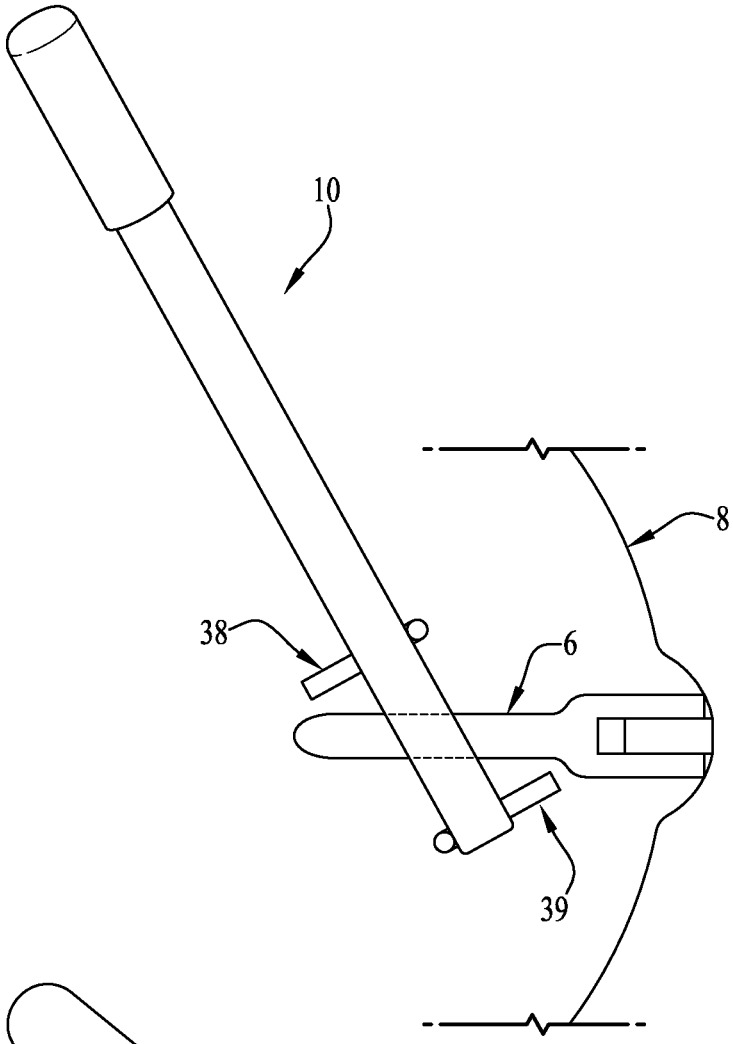
FIG. 6 is a plan view of the hatch-operating tool of FIG. 1 shown in an angled raised position in the process of coupling it to the hatch lever.
Figure 7:
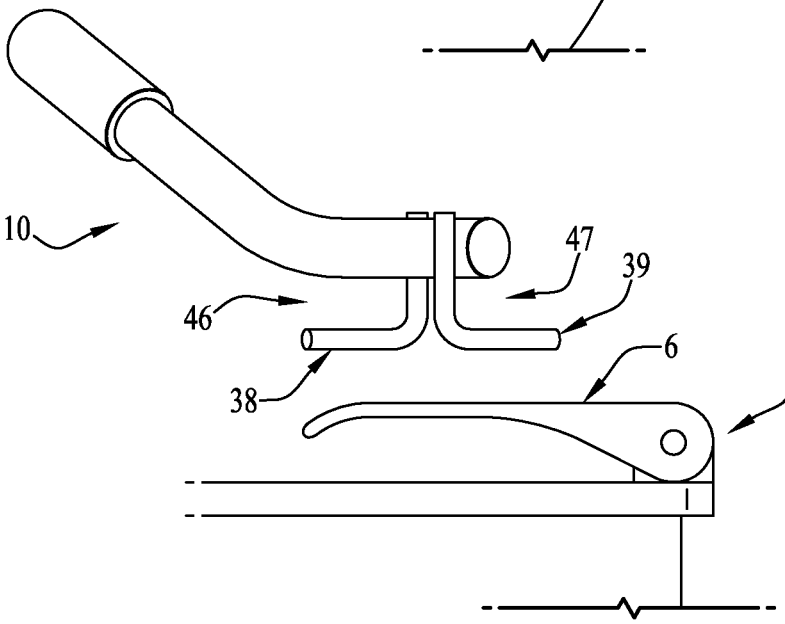
FIG. 7 is a side view of the hatch-operating tool of FIG. 6.
Figure 8:
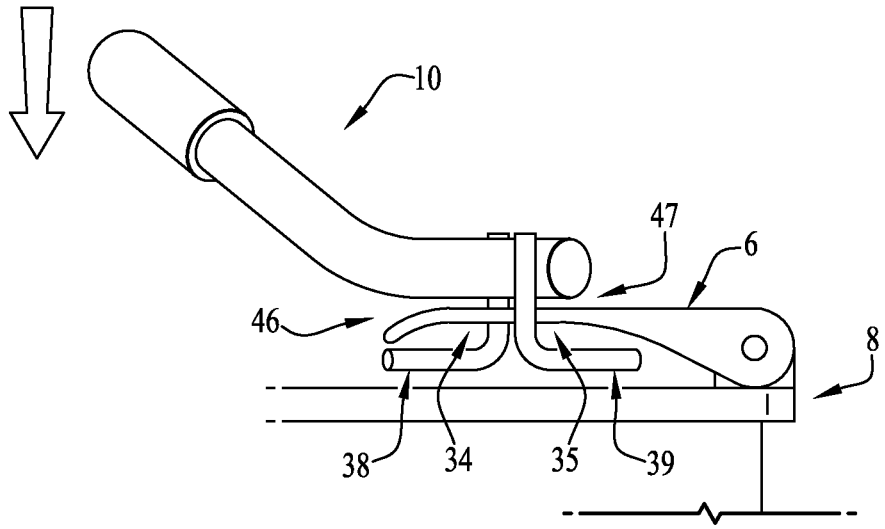
FIG. 8 is a side view of the hatch-operating tool of FIGS. 6-7 shown in an angled lowered position in the process of coupling it to the hatch lever.
Figure 9:
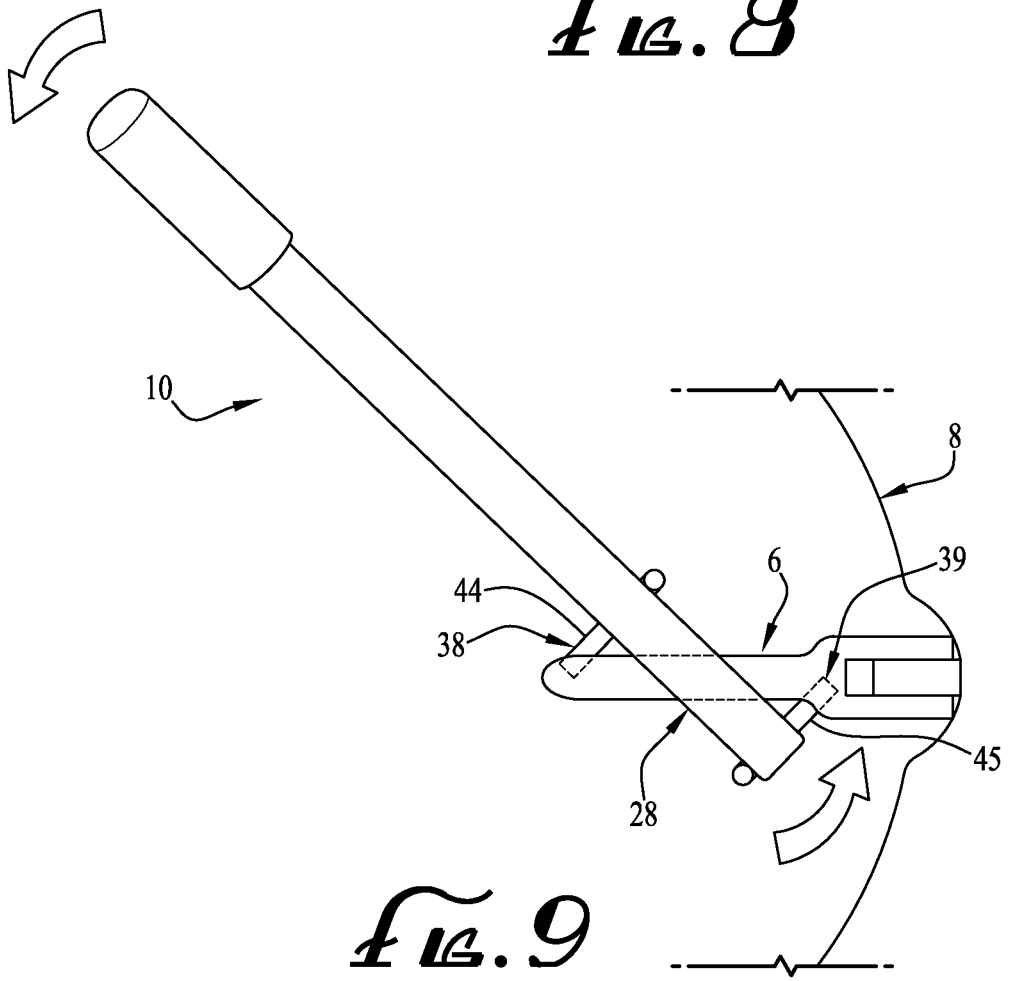
FIG. 9 is a plan view of the hatch-operating tool of FIG. 8 shown being rotated from the angled lowered position toward an aligned lowered or ready position in the process of coupling it to the hatch lever.
Figure 10:
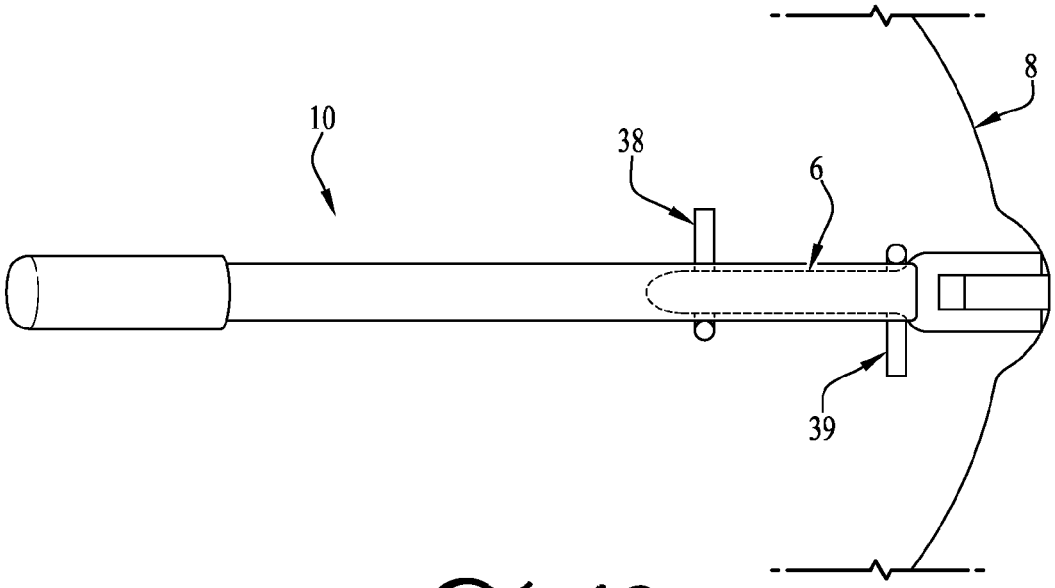
FIG. 10 is a plan view of the hatch-operating tool of FIG. 9 shown in the ready position removably coupled to the hatch lever.
Figure 11:
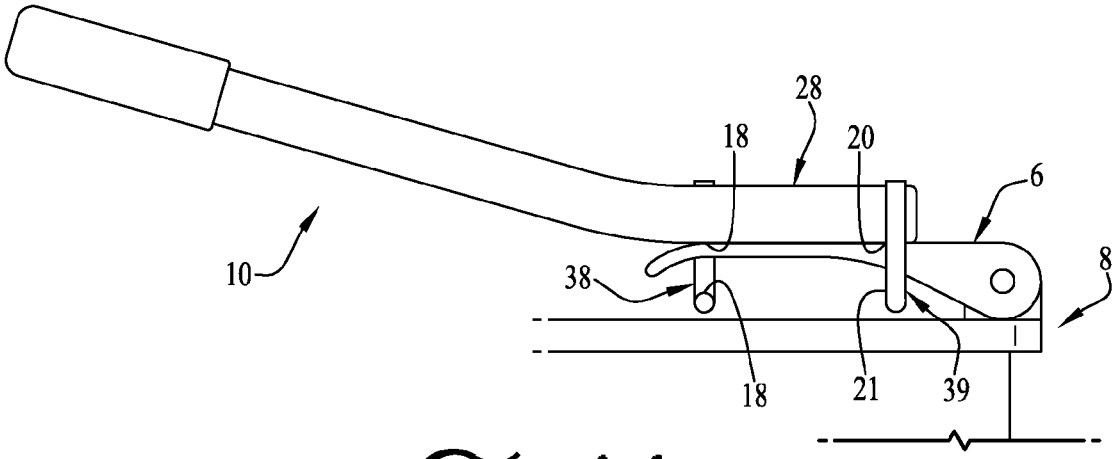
FIG. 11 is a side view of the hatch-operating tool of FIG. 10.

Referring additionally to FIGS. 6-11, there is depicted a method of installing the tool 10 on the hatch lever 6 for use. First, the tool 10 is placed in an angled and raised position relative to the hatch lever 6, as shown in FIGS. 6-7. Then the tool 10 is lowered to an angled lowered position with the hatch lever 6 between the retainers 38 and 39, as shown in FIG. 8. And then the tool 10 is rotated in a generally horizontal plane so that the retainer receptacles 34 and 35 receive the hatch lever 6 through their respective side access openings 46 and 47 so that the respective holder arms 44 and 45 rotate into position to under the hatch lever while the lever-member attachment section 28 rotates into position above it, as shown in FIG. 9. The tool 10 is so rotated until it reaches an aligned lowered (i.e., ready) position in which it is now removably mounted to the hatch lever 6 ready for use, as shown in FIGS. 10-11. In this position, the bearing surfaces 18-21 are all facing inward and aligned with and adjacent (contacting and/or close to contacting) the hatch lever 6, with the distal bearing surfaces 20 and 21 generally adjacent a pivot point of the hatch lever and the proximal bearing surfaces 18 and 19 generally adjacent an angled free end of the hatch lever. This process can then be reversed to remove the tool 10 from the hatch lever 6.

Referring additionally to FIGS. 12-17, there is depicted a method of operating a hatch lever 6 according to another aspect of the invention. The method of use can be performed using the tool 10 of the first embodiment (as described herein) or other tools within the scope of the present invention.

Figure 13:
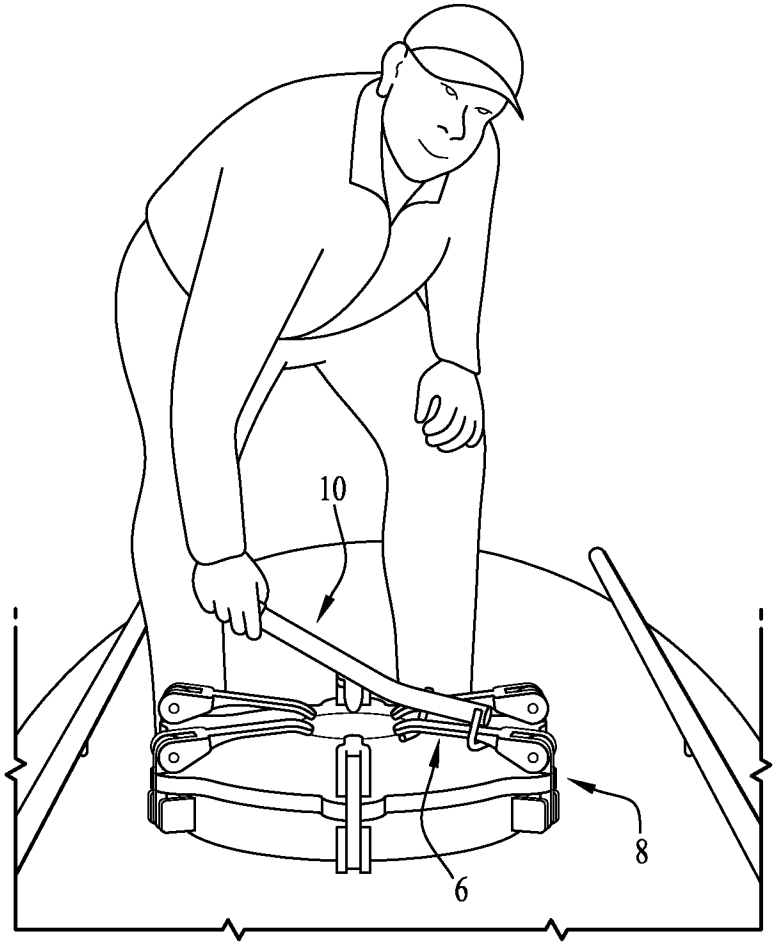
FIG. 13 is a perspective view of the hatch-operating tool of FIG. 12 in the ready position removably coupled to a hatch lever in the locked position.
Figure 12:
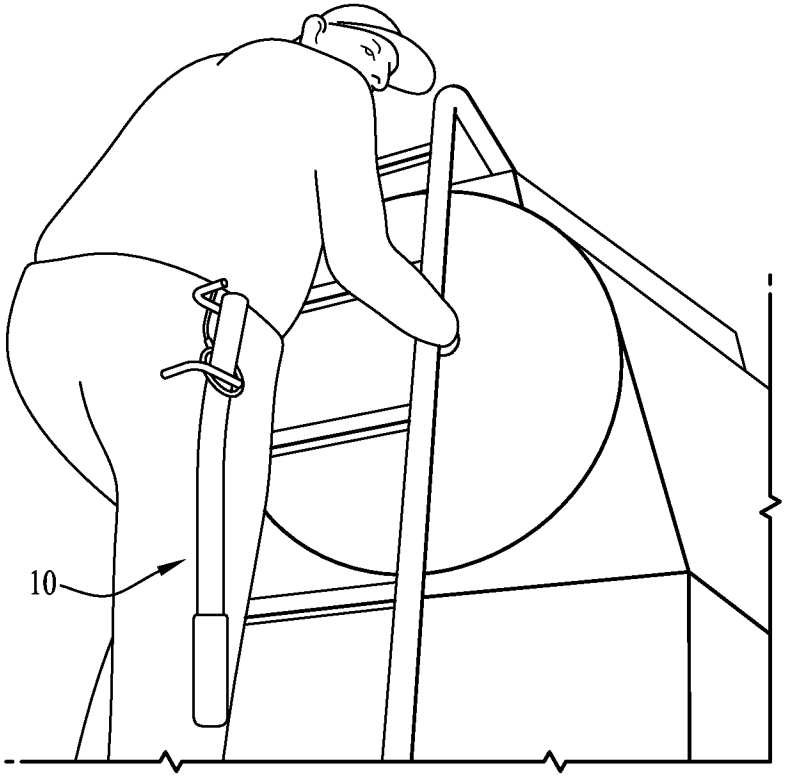
FIG. 12 is a perspective view of the hatch-operating tool of FIG. 1 shown being carried by an operator up a ladder of a tank trailer for use.
Figure 15:
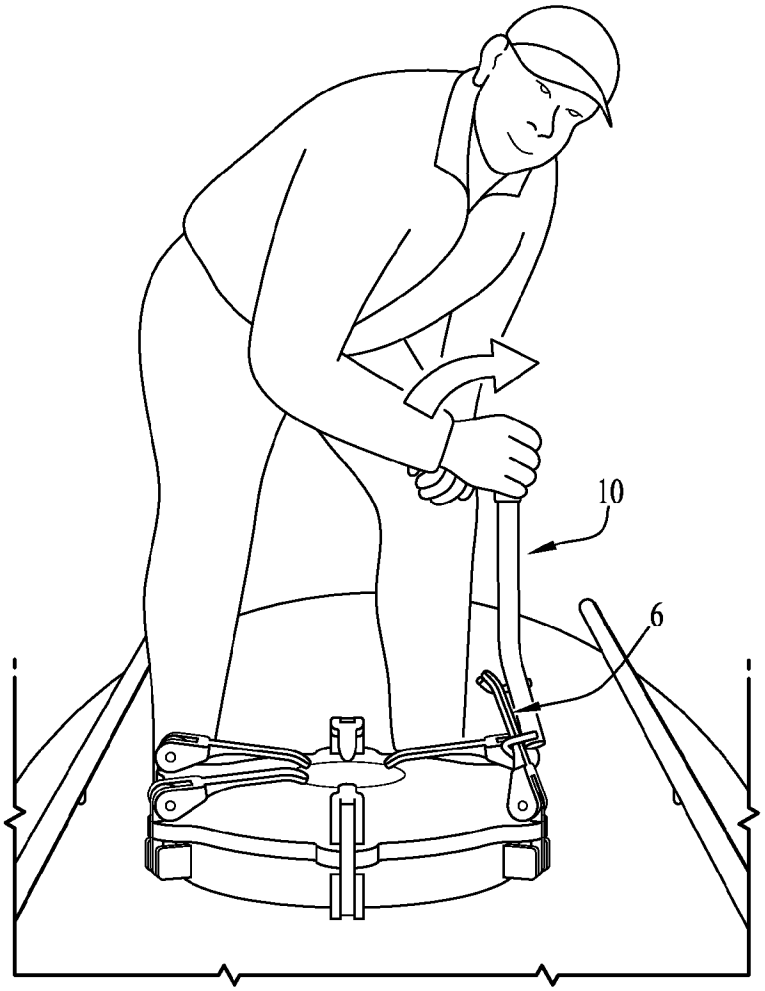
FIG. 15 shows the hatch-operating tool of FIG. 14 being further pivoted upward to further pivot the hatch lever as the cam action is about to snap the hatch lever toward the unlocked position.
Figure 14:
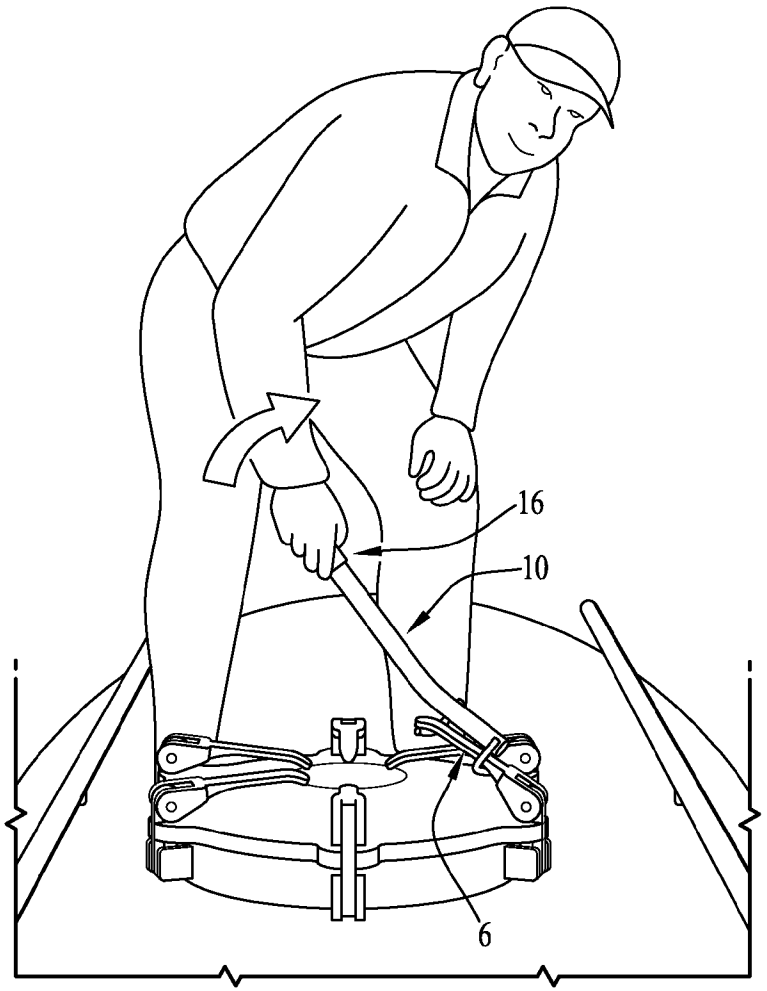
FIG. 14 shows the hatch-operating tool of FIG. 13 being pivoted upward to pivot the hatch lever from the locked position toward the unlocked position.
Figure 17:
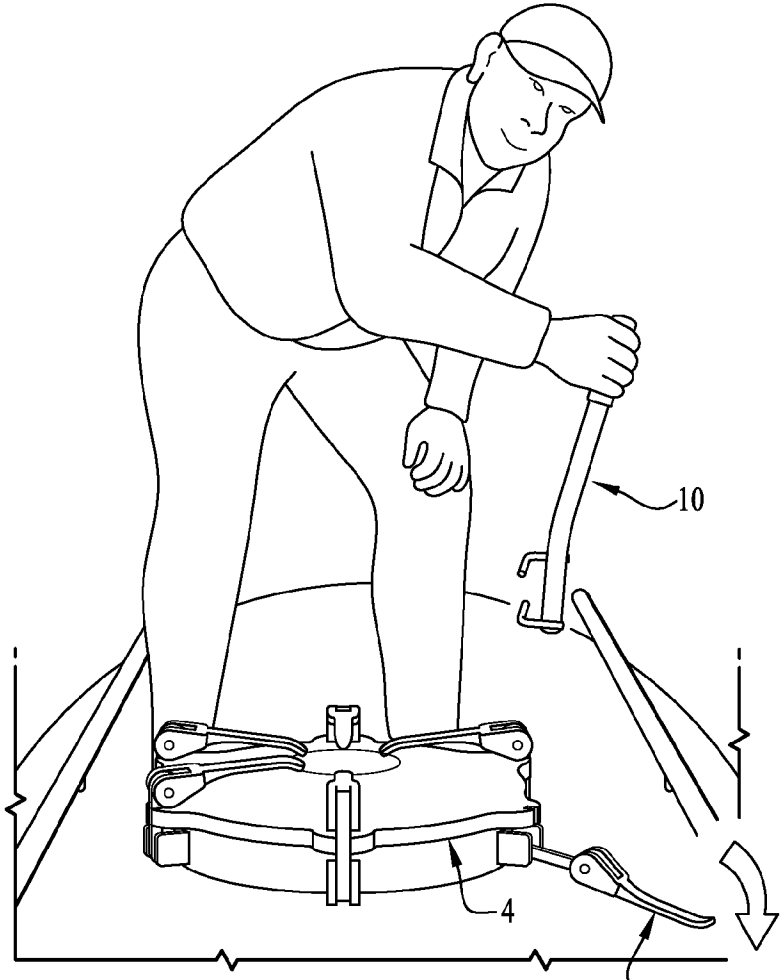
FIG. 17 shows the hatch-operating tool of FIG. 16 uncoupled from the hatch lever after use, with the hatch lever in the unlocked position.
Figure 16:
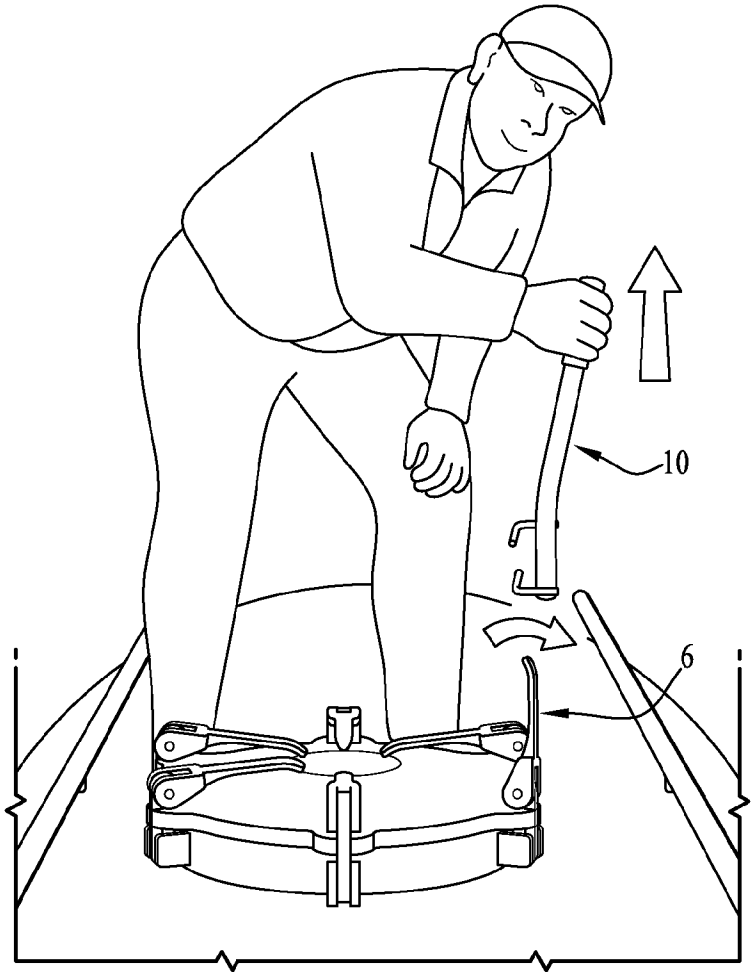
FIG. 16 shows the hatch-operating tool of FIG. 15 releasing from the hatch lever as the cam action is snapping the hatch lever toward the unlocked position.

The method of use includes a user climbing a ladder on the trailer tanker trailer while carrying the tool 10, as shown in FIG. 12, then mounting the tool onto the first lever 6 of the first hatch atop the trailer tanker, as shown in FIG. 13 and as described and shown with respect to FIGS. 6-11. Then the user applies an upward pivotal opening force to the tool handle 16, causing the proximal-lower bearing surface 18 and the distal upper bearing surface 20 to bear upon and torque the hatch lever 6 to pivot upward with it (as indicated by the angular arrow), as shown in FIG. 14. The tool 10 and hatch lever 6 are pivoted further through the pivotal opening motion (as indicated by the angular arrow) under increasing resistance due to the cam peak of the hatch lever being pivoted closer to engagement, as shown in FIG. 15. As the hatch lever 6 pivots past its cam peak, this produces a jerking effect with reduced resistance causing the hatch lever to rapidly accelerate further in its pivotal opening motion (as indicated by the angular arrow), which in turn causes the tool 10 to be jerked upward and longitudinally slid off of the hatch lever (as indicated by the linear arrow), as shown in FIG. 16. Under this acceleration force, the hatch lever 6 pivots further in its opening motion (as indicated by the angular arrow), until it is clear of the hatch cover 4 in the opened/unlocked position, as shown in FIG. 17.

Under this acceleration force, the tool 10 is automatically disengaged from the hatch lever 6 in one fluid motion, so the user can then proceed to the next hatch lever quickly and easily. The same process can then be repeated sequentially for the other levers 6 of the same hatch 8 until the hatch is unlocked. Then the hatch cover 4 can be pivoted to its open position so cargo can be loaded through the hatch access opening. And this process can be repeated for the other hatches 8 of the tank trailer.

After loading the cargo, the hatch covers 4 are pivoted back to their closed positions, and the hatch levers 6 are sequentially closed/locked by reversing the above process. In this reversed closing/locking process, however, the proximal-upper closing bearing surface 19 and the distal-lower closing surface 21 of the tool 10 are what bear upon and torque the hatch lever 6 to pivot downward with it.

Advantageously, the user can hold and operate the tool 10 with one hand while using the other hand to hold onto the rails running the length of the trailers so they are more secure while that high up in the air. In addition, the tool 10 has been job-tested so even an about 120-pound woman driver-user, of whom there are quite a few, can perform her job without great effort and quite effectively. Furthermore, the tool 10 of the depicted embodiment has no moving parts and is easy to make and use.

The robust design and construction of the tool 10 has been found to have additional advantages. For example, the tool 10 can also be used to check tire pressure on the semi rig tires by the "thump" method. And the tool 10 can also be used to tighten or loosen either "cam over" or "ratchet type" load binders.

Figure 18:
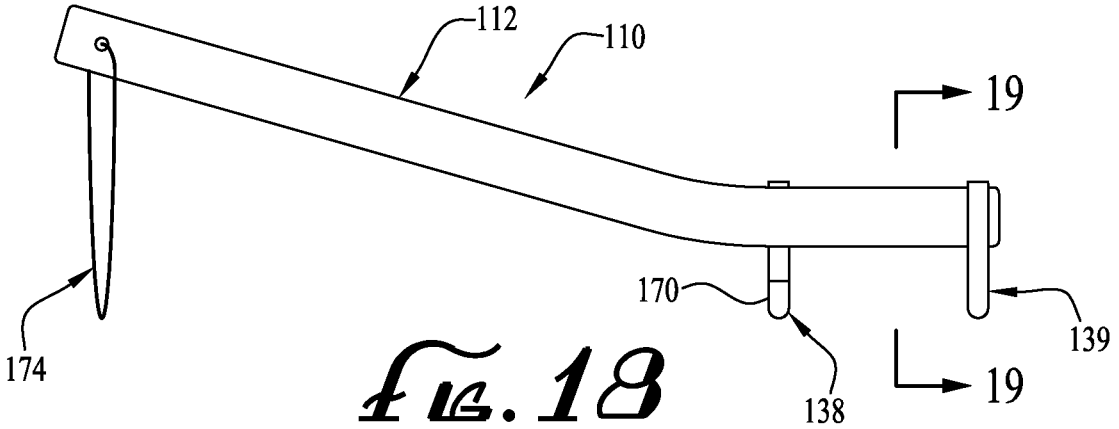
FIG. 18 is a side view of a hatch-operating tool for pneumatic tank trailers according to a second example embodiment of the present invention.
Figure 19:
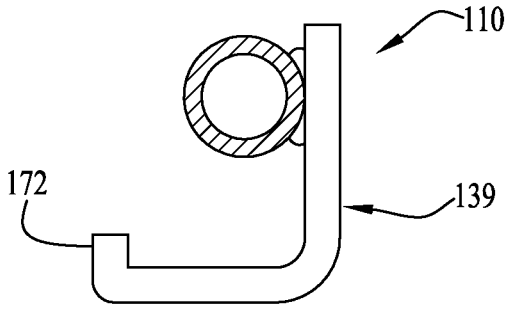
FIG. 19 is a cross-sectional view of the hatch-operating tool taken at line 19-19 of FIG. 18.

FIGS. 18-19 show a hatch-operating tool 110 according to a second example embodiment of the invention. This tool 110 is substantially similar to that of the first embodiment, expect with differences as noted. In particular, the retainers 138 and 139 include upturned free ends 170 and 172 (e.g., ¼-inch extensions) to help with retention on the hatch levers 6. In addition, a lanyard 174 can be provided adjacent the proximal end of the lever member 112 to assist in securely holding the tool 10 by the user.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A tool for operating a first pivotal lever of a hatch of a pneumatic tank trailer, the hatch having a second pivotal lever opposite and aligned with the first pivotal lever, the tool comprising:

a lever member having a proximal handle section, a distal attachment section, and an intermediate extension section therebetween, wherein the handle section is adapted for manual grasping, and wherein the extension section separates the handle and attachment sections to provide mechanical advantage; and an attachment on the attachment section of the lever member, wherein in a use position the attachment longitudinally aligns and overlaps with the pivotal lever, the attachment includes proximal-lower and distal-upper bearing surfaces that contact the pivotal lever to transmit a pivotal opening force in an upward angular opening direction, and the attachment includes proximal-upper and distal-lower bearing surfaces that contact the pivotal lever to transmit a pivotal closing force in a downward angular closing direction that is opposite to the opening direction, wherein the attachment includes a proximal retainer and a distal retainer, the proximal retainer extending from the lever member and defining the proximal-lower bearing surface, the distal retainer extending from the lever member and defining the distal-lower bearing surface, the proximal-lower bearing surface and the distal-upper bearing surface being spaced apart by a longitudinal spacing, the proximal-lower bearing surface positioned opposite the proximal-upper bearing surface and the distal-upper bearing surface positioned opposite the distal-lower bearing surface, wherein the proximal and distal retainers each form a respective receptacle and a respective side access opening, wherein each of the retainer receptacles receives the pivotal lever though the respective side access opening, the proximal and distal retainers are oppositely arranged with their respective side access openings on opposite sides of the lever member, and the proximal and distal retainers are longitudinally spaced to define a mounting opening between them, wherein, for mounting, the tool is positioned at an angle to the pivotal lever then lowered until the pivotal lever is received in the mounting opening between the proximal and distal retainers, then rotated until the pivotal lever is received through the oppositely arranged side access openings and positioned in the respective receptacles in the use, and wherein the extension section of the lever member extends proximally from a proximal end of the attachment section of the lever member, the lever member defines a clearance angle relative to the proximal-lower and distal-lower bearing surfaces, the clearance angle is formed in the lever member between and defining the attachment and extension sections the clearance angle is located adjacent and proximal the proximal end of the proximal retainer, and the clearance angle is about 5 degrees to about 20 degrees to provide clearance of and avoid interference between the tool and the opposite second pivotal lever when the tool is mounted onto the first pivotal lever for use while still providing leverage to the distal and proximal retainers by applying the pivotal opening and closing forces to the handle section.

2. The pneumatic tank trailer hatch tool of claim 1, wherein the clearance angle is formed between a centerline of the extension section of the lever member and a longitudinal line defined by the proximal-lower and distal-lower bearing surfaces.

3. The pneumatic tank trailer hatch tool of claim 1, wherein the longitudinal spacing is short enough that in the use position the proximal-lower and distal-upper bearing surfaces maintain bearing contact with the lever member but long enough to provide a mechanical advantage during use.

4. The pneumatic tank trailer hatch tool of claim 1, wherein the proximal retainer includes an extension arm that extends downward from the lever member and a holder arm that extends at an angle from the extension arm to define the proximal-lower bearing surface facing the lever member and at an offset spacing therefrom.

5. The pneumatic tank trailer hatch tool of claim 1, wherein the proximal-upper bearing surface, the distal-upper bearing surface, or both, is or are defined by the lever member.

6. The pneumatic tank trailer hatch tool of claim 4, wherein the proximal retainer extension and holder arms cooperate with the lever member to define the respective receptacle that receives the pivotal lever and the respective side access opening through which the pivotal lever is received into the receptacle.

7. The pneumatic tank trailer hatch tool of claim 1, wherein the distal retainer includes an extension arm that extends downward from the lever member and a holder arm that extends at an angle from the extension arm to define the distal-lower bearing surface facing the lever member and at an offset spacing therefrom.

8. The pneumatic tank trailer hatch tool of claim 7, wherein the distal retainer extension and holder arms cooperate with the lever member to define the respective receptacle that receives the pivotal lever and the respective side access opening through which the pivotal lever is received into the receptacle.

9. The pneumatic tank trailer hatch tool of claim 1, wherein the proximal and distal retainers are each in form of a respective hook.

10. A method of operating the first pivotal lever of the hatch of the pneumatic tank trailer using the pneumatic tank trailer hatch tool of claim 1, comprising:

mounting the tool onto the pivotal lever;

applying a pivotal force to the tool handle to transmit the pivotal force through the tool and to the pivotal lever, without interference with the opposite and aligned second pivotal lever, to pivot the first pivotal lever in the upward angular opening direction; and removing the tool from the pivotal lever in an axial direction by automatic disengagement caused by the pivotal lever accelerating after a cam peak of the pivotal lever is passed.

* * * * *